US011222616B2

(12) United States Patent
Volkov

(10) Patent No.: US 11,222,616 B2
(45) Date of Patent: Jan. 11, 2022

(54) SECURING DEVICE FOR PIANO STRINGS

(71) Applicant: Vladislav Vladimirovich Volkov, g. Oktyabrsky (RU)

(72) Inventor: Vladislav Vladimirovich Volkov, g. Oktyabrsky (RU)

( * ) Notice: Subject to any disclaimer, the term of this patent is extended or adjusted under 35 U.S.C. 154(b) by 0 days.

(21) Appl. No.: 17/257,757

(22) PCT Filed: May 7, 2019

(86) PCT No.: PCT/RU2019/000315
§ 371 (c)(1),
(2) Date: Jan. 4, 2021

(87) PCT Pub. No.: WO2019/231354
PCT Pub. Date: Dec. 5, 2019

(65) Prior Publication Data

US 2021/0158785 A1 May 27, 2021

(30) Foreign Application Priority Data

Jun. 1, 2018 (RU) ..... RU2018120396

(51) Int. Cl.

| | |
|---|---|
| ***G10C 3/106*** | (2019.01) |
| ***G10C 3/07*** | (2019.01) |
| ***G10C 3/04*** | (2006.01) |
| ***G10C 3/06*** | (2006.01) |

(52) U.S. Cl.
CPC ..... *G10C 3/106* (2013.01); *G10C 3/04* (2013.01); *G10C 3/06* (2013.01); *G10C 3/07* (2019.01)

(58) Field of Classification Search
CPC . G10C 3/106; G10C 3/06; G10C 3/04; G10C 3/10
See application file for complete search history.

(56) References Cited

U.S. PATENT DOCUMENTS 166,253 A * 8/1875 Branig ..... G10C 3/106 84/202
514,976 A * 2/1894 Weber ..... G10C 3/106 84/202
941,730 A * 11/1909 Sack et al. ..... G10C 3/106 84/202

(Continued)

FOREIGN PATENT DOCUMENTS

WO 1995/022815 A1 8/1995
WO 2007/149877 A2 12/2007

OTHER PUBLICATIONS

International Search Report and Written Opinion (with English translation) issued in corresponding International Patent Application No. PCT/RU2019/000315 dated Oct. 3, 2019 (12 pages).

(Continued)

*Primary Examiner* — Robert W Horn
(74) *Attorney, Agent, or Firm* — MH2 Technology Law Group LLP

(57) ABSTRACT

The invention relates to a device for tightening the strings of a keyboard musical instrument. The device provides for rigidly securing a tuning pin in position by means of a collet pressing into a cast-iron frame, an elastic ring being mounted on windings of a string. The present technical improvements increase tuning stability and tuning retention, increase string resistance to breaking, and increase the service life of a musical instrument.

5 Claims, 3 Drawing Sheets

(56) References Cited

U.S. PATENT DOCUMENTS

| | | | | | |
|---|---|---|---|---|---|
| 1,351,616 | A | | 8/1920 | Burke | |
| 1,353,903 | A | * | 9/1920 | Gertz | G10C 3/106 84/200 |
| 2,065,342 | A | * | 12/1936 | Mockly | G10C 3/106 84/202 |
| 2,075,001 | A | * | 3/1937 | Schulze | G10C 3/106 84/201 |
| 3,091,149 | A | * | 5/1963 | Walsh | G10C 3/04 84/186.2 |
| 3,332,309 | A | * | 7/1967 | Signore | G10C 3/106 84/201 |
| 3,424,047 | A | * | 1/1969 | Whited | G10C 3/106 84/202 |
| 3,693,490 | A | * | 9/1972 | Raphael | G10C 3/106 84/202 |
| 3,869,953 | A | * | 3/1975 | Tatebe | G10C 3/106 84/201 |
| 4,398,443 | A | * | 8/1983 | Kovach | G10C 3/10 84/201 |
| 4,920,847 | A | * | 5/1990 | Conklin, Jr. | G10C 3/10 84/202 |
| 4,961,361 | A | * | 10/1990 | Yamagishi | G10C 3/10 84/201 |
| 5,471,902 | A | * | 12/1995 | Chaplin | G10C 3/10 84/202 |
| 5,869,780 | A | * | 2/1999 | Lim | G10C 3/106 84/201 |
| 6,114,615 | A | * | 9/2000 | Larudee | G10C 3/106 84/200 |
| 2021/0158785 | A1 | * | 5/2021 | Volkov | G10C 3/07 |

OTHER PUBLICATIONS

International Preliminary Report on Patentability (with English translation) issued in corresponding International Patent Application No. PCT/RU2019/000315 dated Dec. 2, 2020 (12 pages).

* cited by examiner

SECURING DEVICE FOR PIANO STRINGS

CROSS-REFERENCE TO RELATED APPLICATIONS

This application is a U.S. National Stage Application of International Application No. PCT/RU2019/000315, filed on May 7, 2019, which claims priority to Russian Patent Application No. 2018120396, filed on Jun. 1, 2018, the entire disclosures of which are hereby incorporated by reference in their entireties.

FIELD OF THE INVENTION

The invention relates to manufacturing of keyboard musical instruments, in particular, pianos, grand pianos, clavichords, harpsichords and gusli.

A device for tightening the strings of a keyboard musical instrument is known in the art (I. N. Vyborgskiy, "Piano Repair and Tuning", Kuibyshev Book Publishing House, 1977, pp. 13-18), the device comprising a cast-iron frame, an outer rim and a sound board connected to each other via large screws and bolts, a wooden plug is pressed into the opening of the cast-iron frame, tuning pins are pressed into the wooden plug and into the wooden sound board, string windings are wound on the tuning pin, and the strings are kept tightened by the frictional force of the tuning pin compressed by the wood.

The disadvantages of the prior art tightening device for strings of a keyboard musical instrument include the lack of rigid securing of the elastic string windings on the tuning pin and the lack of rigid securing of the tuning pin in the wood, said disadvantages resulting in rapid detuning when the instrument is played.

SUMMARY OF THE INVENTION

The object of the invention is to provide rigid securing of the string windings on the tuning pin and to provide rigid securing of the tuning pin in the strainer to extend the time period in which the instrument remains properly tuned.

The object is achieved by a device for tightening piano strings, the device comprising a cast-iron frame, an outer rim and a sound board connected to each other via large screws and bolts, wherein the tuning pins are pressed into a wooden plug and into a wooden sound board, and string windings are wound on the pins; in order to improve the quality of maintaining the tuned state, a lock pin is installed into the wooden plug between the cast-iron frame and the tuning pin to rigidly secure the position of the tuning pin, and a ring made of an elastic material is mounted on the string windings to rigidly secure the elastic string windings on the tuning pin.

Comparative analysis shows that in the prior art tightening device for piano strings, during operation of the instrument, the windings of the string on the tuning pin are compressed, the released part of the string from the non-sounding portion of the string slides through the nut into the sounding part of the string, the string loses tension for the set tone, strong hits with the hammer on the string cause the tuning pin to tilt towards the direction of string tightening, the string becomes detuned and the instrument goes out of tune.

The technical solution provided by the tightening device with a lock pin pressed into the wooden plug and with an elastic ring mounted on the string windings provides rigid securing of the position of the tuning pin and a rigid securing of the string windings, which increases tuning retention in the instrument, reduces re-tuning frequency, prevents additional micro-cracks in places where the string is fractured due to frequent adjustments, thus increasing string resistance to breaking and prolonging its service life.

The technical result of the invention is an extended period of quality performance of a keyboard musical instrument after tuning.

Therefore, the disclosed device for tightening piano strings meets the criterion of novelty and significant difference. The description of the invention is illustrated in the accompanying drawings.

DETAILED DESCRIPTION OF THE INVENTION

Figure 1:
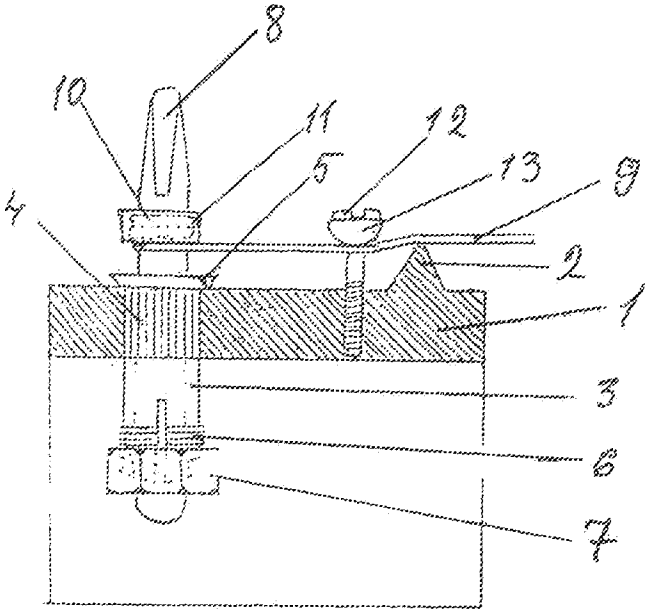
FIG. 1 shows a view of a tightening device with a mounted collet with a lip in the cast-iron frame and with a ring made of an elastic material mounted on string windings.

A device for tightening the strings of a keyboard musical instrument of embodiment 1 (see FIG. 1) comprises: a cast-iron frame 1 with a nut 2, a collet 3 with a lip 5 pressed into the cast-iron frame with corrugation 4, a lock nut 7 screwed onto the thread of blades 6 on the other side of the collet 3, a tuning pin 8 installed in the collet 3, a string 9 installed in the opening (not shown in the figure) of the tuning pin 8, windings 10 of the string 9 wound on the tuning pin 8, an elastic ring 11 sleeved onto the windings 10, and a screw 12 with a clamping plate 13 for the string 9 installed in the cast-iron frame 1.

The elastic ring 8 can be made of any soft material, such as nylon, polyvinyl chloride, silicone, polyurethane, etc.

The device is operated as follows.

A tuning key (not shown in the figure) is placed on the tuning pin 8 (see FIG. 1), the tuning key is turned to tune string 9 to a required pitch; when the hammer strikes string 9 (the hammer not shown in the figure), string 9 does not detune; stable retention of the set pitch is ensured by compressing the windings 10 of the string 9 by means of the elastic ring 11. Upon repeated strikes of the hammer on the string 9, collet 3 ensures reliable retention of the tuning pin 8, preventing it from tilting towards the direction of string 9 tightening, and string 9 is held due to the frictional force between the tuning pin 8 and the blades 6 of the collet 3. The friction between the tuning pin 8 and the blades 6 of the collet 3 is adjusted by tightening or loosening the lock nut 7.

Figure 2:
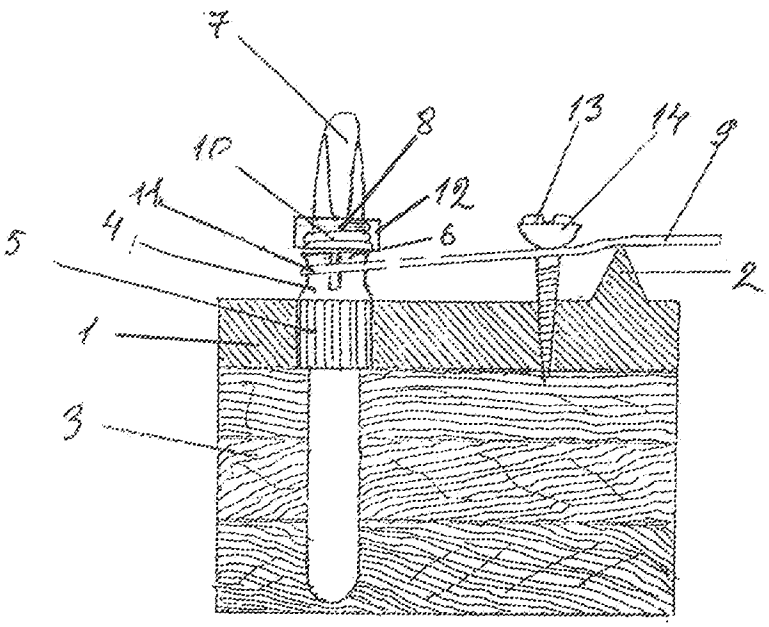
FIG. 2 shows a view of a tightening device with a mounted collet with blades and string windings wound thereon and with a ring made of an elastic material mounted on the string windings.

A device for tightening the strings of a keyboard musical instrument of embodiment 2 (see FIG. 2) comprises: a cast-iron frame 1 with a nut 2, a sound board 3, a collet 4 with blades 6 pressed into the cast-iron frame with corrugation 5, a tuning pin 7 installed in the collet 4, a string 9 installed in the opening 8 of the tuning pin 7, windings 10 of the string 9 wound on the tuning pin 7, a winding 11 wound on the blades 6 of the collet 4, an elastic ring 12 sleeved onto the windings 10, and a screw 13 with a clamping plate 14 for the string 9 installed in the cast-iron frame 1.

The device is operated as follows.

A tuning key (not shown in the figure) is placed on the tuning pin 7 (see FIG. 2), the tuning key is turned to tune string 9 to a required pitch; when the hammer strikes string 9 (the hammer not shown in the figure), string 9 does not detune; stable retention of the set pitch is ensured by compressing the windings 10 of the string 9 by means of the elastic ring 12. Upon repeated strikes of the hammer on the string 9, collet 4 ensures reliable retention of the tuning pin 7, preventing it from tilting towards the direction of string 9 tightening, and string 9 is held due to the frictional force between the tuning pin 7 and the blades 6 of the collet 4 and the sound board 3; an increase in frictional force of the tuning pin 7 is accomplished by increasing the number of windings 10 on the blades 6 of the collet 4, and a decrease in frictional force of the tuning pin 7 is accomplished by reducing the number of windings 10 on the blades 6 of the collet 4.

Figure 3:
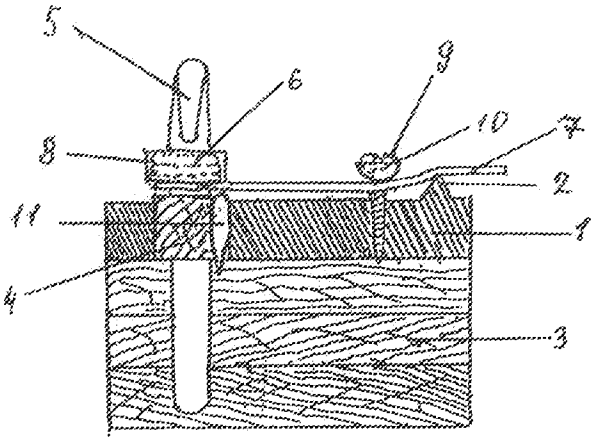
FIG. 3 shows a view of a tightening device with a lock pin in the wooden plug and with a ring made of an elastic material mounted on string windings.

A device for tightening the strings of a keyboard musical instrument of embodiment 3 comprises: a cast-iron frame 1 with a nut 2, a sound board 3 (see FIG. 3), a wooden plug 4 pressed into the cast-iron frame 1, a tuning pin 5 pressed into the wooden plug 4 and the sound board 3, windings 6 of the string 7 wound on the tuning pin 5, an elastic ring 8 sleeved on windings 6, a screw 9 with a clamping plate 10 for the string 7 installed in the cast-iron frame 1, and a lock pin 11 pressed into the wooden plug 4 and the sound board 3.

The device is operated as follows.

A tuning key (not shown in the figure) is placed on the tuning pin 5, the tuning key is turned to tune string 7 to a required pitch (see FIG. 3); when the hammer strikes string 7 (the hammer not shown in the figure), the string 7 does not detune; stable retention of the set pitch is ensured by compressing the windings 6 of the string 7 by means of the elastic ring 8; upon repeated strikes of the hammer on the string 7 (the hammer not shown in the figure), lock pin 11 pressed into the wooden plug 4 and the sound board 3 ensures reliable retention of the tuning pin 5, preventing it from tilting towards the direction of string 7 tightening; the string 7 is prevented from unwinding from the tuning pin 5 due to frictional force of the tuning pin 5 being compressed by the wood of the sound board 3 and of the wooden plug 4.

Figure 4:
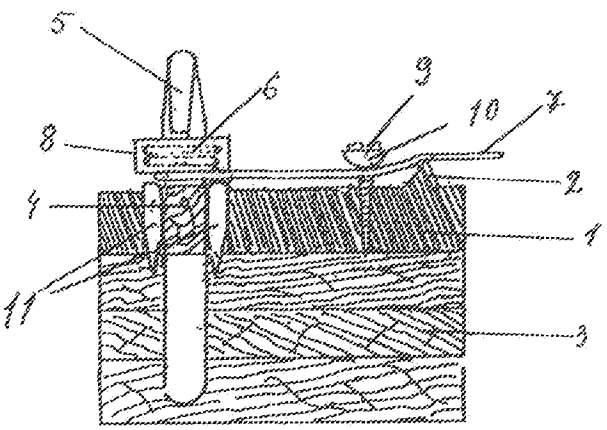
FIG. 4 shows a view of a tightening device with additional lock pins in the wooden plug and with a ring made of an elastic material mounted on string windings.

A device for tightening the strings of a keyboard musical instrument of embodiment 4 comprises: a cast-iron frame 1 with a nut 2, a sound board 3 (see FIG. 4), a wooden plug 4 pressed into the cast-iron frame 1, a tuning pin 5 pressed into the wooden plug 4 and the sound board 3, windings 6 of the string 7 wound on the tuning pin 5, an elastic ring 8 sleeved on windings 6, a screw 9 with a clamping plate 10 for the string 7 installed in the cast-iron frame 1, and lock pins 11 pressed into the wooden plug 4 and the sound board 3.

The device is operated as follows.

A tuning key (not shown in the figure) is placed on the tuning pin 5, the tuning key is turned to tune string 7 to a required pitch (see FIG. 4); when the hammer strikes string 7 (the hammer not shown in the figure), the string 7 does not detune; stable retention of the set pitch is ensured by compressing the windings 6 of the string 7 by means of the elastic ring 8; upon repeated strikes of the hammer on the string 7, lock pins 11 pressed into the wooden plug 4 and the sound board 3 ensure reliable retention of the tuning pin 5, preventing it from tilting towards the direction of string 7 tightening, thus providing a rigid position for the tuning pin 5; the string 7 is held due to frictional force of the tuning pin 5 being compressed by the wood of the sound board 3 and of the wooden plug 4.

Figure 5:
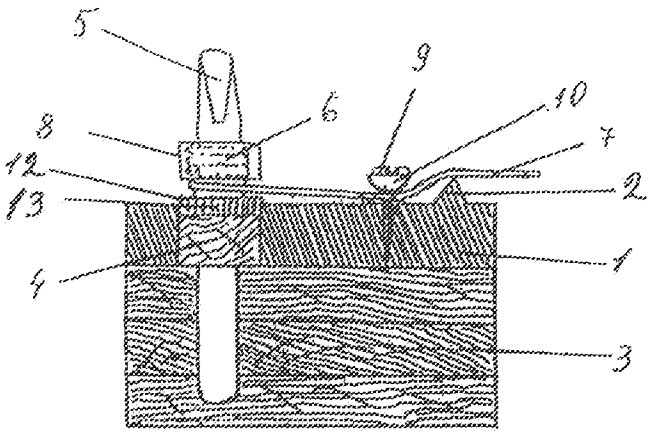
FIG. 5 shows a view of a tightening device with a washer in the cast-iron frame and with a ring made of an elastic material mounted on string windings.

A device for tightening the strings of a keyboard musical instrument of embodiment 5 comprises: a cast-iron frame 1 with a nut 2, a sound board 3 (see FIG. 5), a wooden plug 4 pressed into the cast-iron frame 1, a tuning pin 5 pressed into the wooden plug 4 and the sound board 3, windings 6 of the string 7 wound on the tuning pin 5, an elastic ring 8 sleeved on windings 6, a screw 9 with a clamping plate 10 for the string 7 installed in the cast-iron frame 1, and a washer 12 with corrugation 13 pressed into the cast-iron frame 1 with the tuning pin 5 installed in the opening of the washer 12 (the opening not shown in the figure).

The washer 12 with corrugation 13 can be pressed into the cast iron frame 1 and installed between the wooden plug 4 and the sound board 3 (not shown in the figure).

The device is operated as follows.

A tuning key (not shown in the figure) is placed on the tuning pin 5 (see FIG. 5), the tuning key is turned to tune string 7 to a required pitch; when the hammer strikes string 7 (the hammer not shown in the figure), string 7 does not detune; stable retention of the set pitch is ensured by compressing the windings 6 of the string 7 by means of the elastic ring 8. Upon repeated strikes of the hammer on the string 7, the tuning pin 5 installed in the opening of the washer 12 is securely held by the washer 12, preventing the tuning pin 5 from tilting towards the direction of string 7 tightening; the string 7 is held due to frictional force of the tuning pin 5 being compressed by the wood of the sound board 3 and of the wooden plug 4.

The technical improvements introduced into the tightening device increase tuning stability and tuning retention, reduce the frequency of periodic re-tuning, prevent additional micro-cracks in places where the string is fractured, thus increasing string resistance to breaking and prolonging the service life of the musical instrument.

INDUSTRIAL APPLICABILITY

The invention can be used in manufacturing of keyboard musical instruments and in modernizing previously available models of pianos, grand pianos, clavichords, harpsichords and gush.

The invention claimed is:

1. A device for tightening piano strings, the device comprising a cast-iron frame, an outer rim and a sound board connected to each other via large screws and bolts, wherein a wooden plug is pressed into the opening of the cast-iron frame, tuning pins are pressed into the wooden plug and into a wooden sound board, and string windings are wound on the tuning pins, characterized in that a collet with a lip is pressed into the cast-iron frame with corrugation, the tuning pin is installed in the collet, and an elastic ring is sleeved onto the string windings.

2. A device for tightening piano strings, the device comprising a cast-iron frame, an outer rim and a sound board connected to each other via large screws and bolts, wherein a wooden plug is pressed into the opening of the cast-iron frame, tuning pins are pressed into the wooden plug and into a wooden sound board, and string windings are wound on the tuning pins, characterized in that a collet is pressed into the cast-iron frame with corrugation, the tuning pin is installed in the collet, the tuning pin is pressed into the sound board, an elastic ring is sleeved onto the string windings, and a string winding is wound on the blades of the collet.

3. A device for tightening piano strings, the device comprising a cast-iron frame, an outer rim and a sound board connected to each other via large screws and bolts, wherein a wooden plug is pressed into the opening of the cast-iron frame, tuning pins are pressed into the wooden plug and into a wooden sound board, and string windings are wound on the tuning pins, characterized in that a lock pin is pressed into the wooden plug and the sound board, and an elastic ring is sleeved onto the string windings.

4. A device for tightening piano strings, the device comprising a cast-iron frame, an outer rim and a sound board connected to each other via large screws and bolts, wherein a wooden plug is pressed into the opening of the cast-iron frame, tuning pins are pressed into the wooden plug and into a wooden sound board, and string windings are wound on the tuning pins, characterized in that lock pins are pressed into the wooden plug and the sound board, and an elastic ring is sleeved onto the string windings.

5. A device for tightening piano strings, the device comprising a cast-iron frame, an outer rim and a sound board connected to each other via large screws and bolts, wherein a wooden plug is pressed into the opening of the cast-iron frame, tuning pins are pressed into the wooden plug and into a wooden sound board, and string windings are wound on the tuning pins, characterized in that a washer with corrugation is pressed into the cast-iron frame, the tuning pin is installed in the opening of the washer, and an elastic ring is sleeved onto the string windings.

* * * * *